US009670032B1

(12) United States Patent
Watkins

(10) Patent No.: US 9,670,032 B1
(45) Date of Patent: Jun. 6, 2017

(54) REMOVABLE RAMP FOR REELS AND SPOOLS

(71) Applicant: Sonoco Development, Inc., Hartsville, SC (US)

(72) Inventor: Eric Watkins, Athens, AL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 14/980,830

(22) Filed: Dec. 28, 2015

(51) Int. Cl.
*B65H 75/18* (2006.01)
*B65H 75/14* (2006.01)

(52) U.S. Cl.
CPC ..... *B65H 75/18* (2013.01); *B65H 75/14* (2013.01)

(58) Field of Classification Search
CPC ..... B65H 75/14; B65H 75/18; B65H 75/28
See application file for complete search history.

(56) References Cited

U.S. PATENT DOCUMENTS 1,913,508 A * 6/1933 Phillips ..... B66D 1/34 242/587.1
2,678,863 A 5/1954 Atkinson et al.
2,732,150 A * 1/1956 Le Bus, Sr ..... B65H 75/265 242/587
2,892,598 A * 6/1959 Dudley ..... B66D 1/36 242/586.1
4,071,205 A 1/1978 Wieschel
4,938,432 A * 7/1990 Kurt ..... B65H 75/28 242/125.1
2004/0206849 A1* 10/2004 Harrington ..... B65H 75/26 242/586
2015/0360903 A1* 12/2015 Longo ..... B65H 75/40 242/397

FOREIGN PATENT DOCUMENTS

GB 954245 A * 4/1964 ..... B65H 75/025

* cited by examiner

*Primary Examiner* — William E Dondero
(74) *Attorney, Agent, or Firm* — Miller, Matthias & Hull LLP

(57) ABSTRACT

A reel for winding cable comprising a drum, a first flange, a second flange and a ramp removably affixed to a flange. The ramp extends around part of the drum adjacent the inner side of the first flange. The ramp has a cylindrical drum facing surface which mates with the cylindrical surface of the drum, and a smooth continuous cable supporting surface. The ramp may comprise at least two sections. Preferably the ramp is made of a lightweight material such as plastic or dense foam.

17 Claims, 11 Drawing Sheets

REMOVABLE RAMP FOR REELS AND SPOOLS

BACKGROUND OF THE INVENTION

Field of the Invention

This disclosure relates to reels or spools. More particularly, this disclosure relates to a removable ramp for a reel or spool.

Description of the Related Art

Reels and spools (referred to hereinafter as "reels") are used to store cable and wire. Access to both ends of the wound cable or wire is required to conduct a continuity test to determine whether the cable or wire has been compromised. Some reels have integrally formed (built in) ramps to enable access to the inner end of the wound cable or wire.

Unfortunately, reels having built in ramps are difficult to manufacture and very labor intensive to make. Also, the built in ramps are permanent fixtures of the reel and cannot be switched out. Customers who require ramp widths that are dependent on the cable diameter must buy complete new reels every time they use a different diameter cable.

The present disclosure is designed to solve the problems described above.

BRIEF SUMMARY OF THE INVENTION

The present disclosure relates to a reel for winding cable. The reel comprises a drum, a first flange, a second flange and a removable ramp. The drum comprises opposing axial ends and a cylindrical drum surface. The first flange is affixed to one drum end and the second flange is affixed to the other drum end. The first flange has a radially outer edge, an inner side facing the drum and an outer side.

The ramp extends around part of the drum adjacent the inner side of the first flange. The ramp has a cylindrical drum facing surface which mates with the cylindrical surface of the drum, and a smooth continuous cable supporting surface. The ramp is removably affixed to the first flange. In a preferred embodiment the ramp comprises at least two sections joined together. Preferably the ramp is made of a lightweight material such as plastic or dense foam.

In another aspect the disclosure relates to a reel system for winding cables of varying diameters. The reel system comprises a reel and a plurality of interchangeable ramps of different widths. Each ramp has a smooth continuous cable supporting surface and is configured to extend circumferentially around part of the drum outer surface adjacent the inner facing surface of one of the flanges. Each ramp comprises at least two sections joined together and configured to be removably affixed to the reel. Preferably the ramps are made of a lightweight material such as plastic or dense foam.

DETAILED DESCRIPTION OF THE INVENTION

Figure 1:
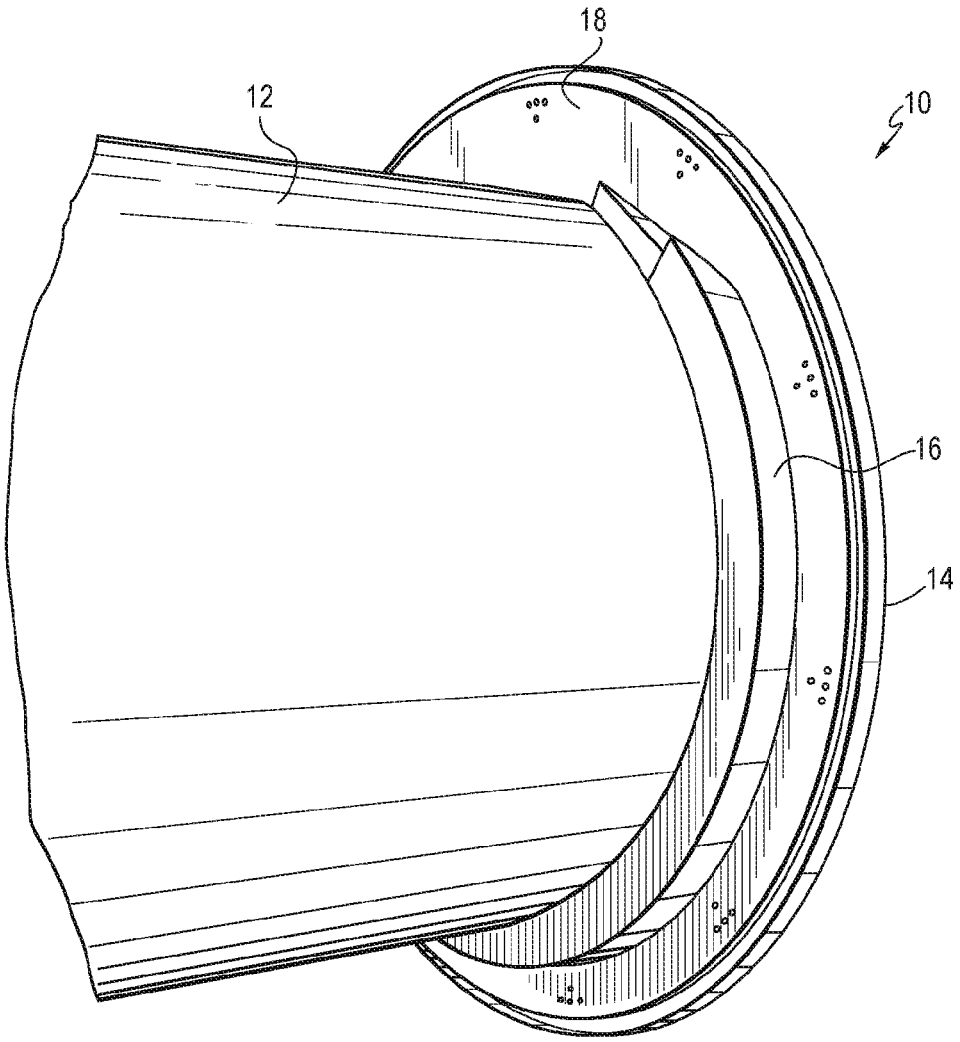
Fig. 1 Prior Art
FIG. 1 is a perspective view of a portion of a prior art reel.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments.

Reels are used to store cable and wire. Access to both ends of the wound cable or wire is required to conduct a continuity test to determine whether the cable or wire has been compromised. Some reels have integrally formed (built in) ramps to enable access to the inner end of the wound cable or wire.

Prior Art

FIG. 1 is a perspective view of a portion of a prior art reel 10. The reel comprises a drum 12 and disc-shaped flanges 14 affixed to the ends of the drum 12. A ramp 16 extends around part of the drum 12 adjacent the inner facing surface 18 of one of the flanges 14. The ramp 16 is a built in ramp, that is, a permanent, integral part of the reel 10 that cannot be removed.

Reel

Figure 2:
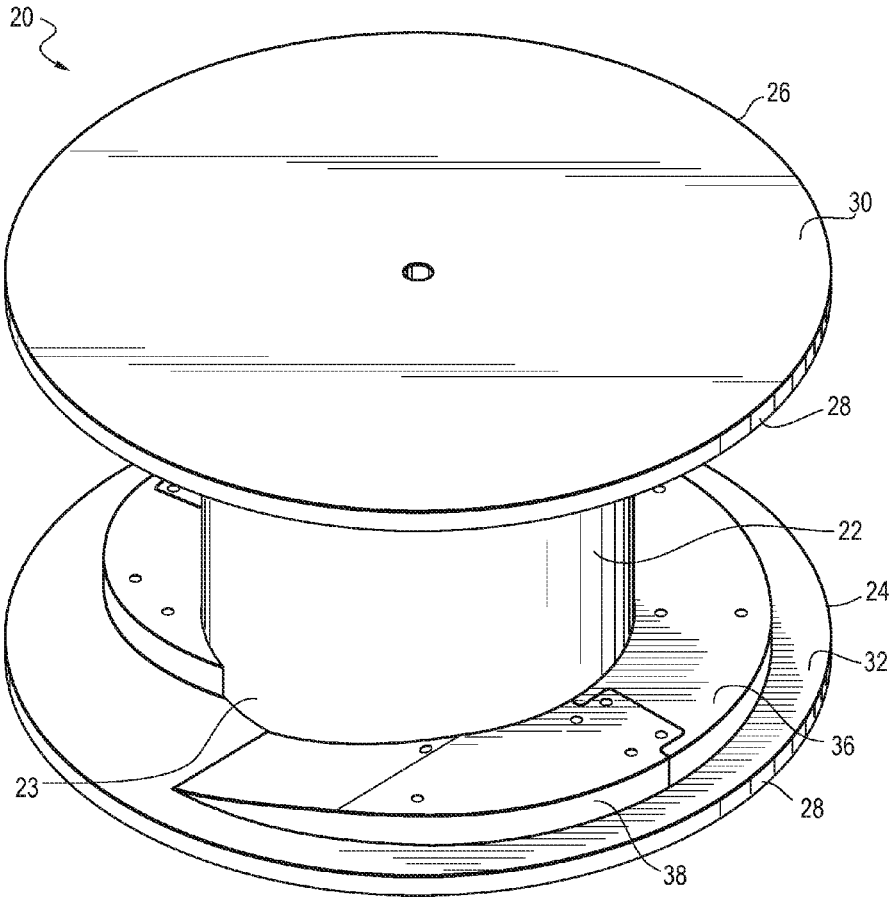
FIG. 2 is a perspective view of a reel according to the disclosure.

FIG. 2 is a perspective view of a reel 20 according to the disclosure. The reel 20 comprises a drum 22 defining a longitudinal axis about which the drum may rotate. The drum 22 has opposing axial ends and a smooth cylindrical drum surface 23 on which a cable 40 (not shown in FIG. 2) may be wound. A disc-shaped first flange 24 is affixed to one drum end and a disc-shaped second flange 26 is affixed to the opposite end. The first flange 24 defines receiving holes 34 for receiving bolts or other attachment means as explained below.

Each flange 24, 26 has a radially outer edge 28, an inner (drum facing) side 32 and an outer side 30. A ramp 36 extends around part of the drum circumference adjacent the inner side 32 of the first flange 24. As described in more detail below, the ramp 36 may comprise separate sections that are removably affixed to the flange 24.

Ramp

Figure 3:
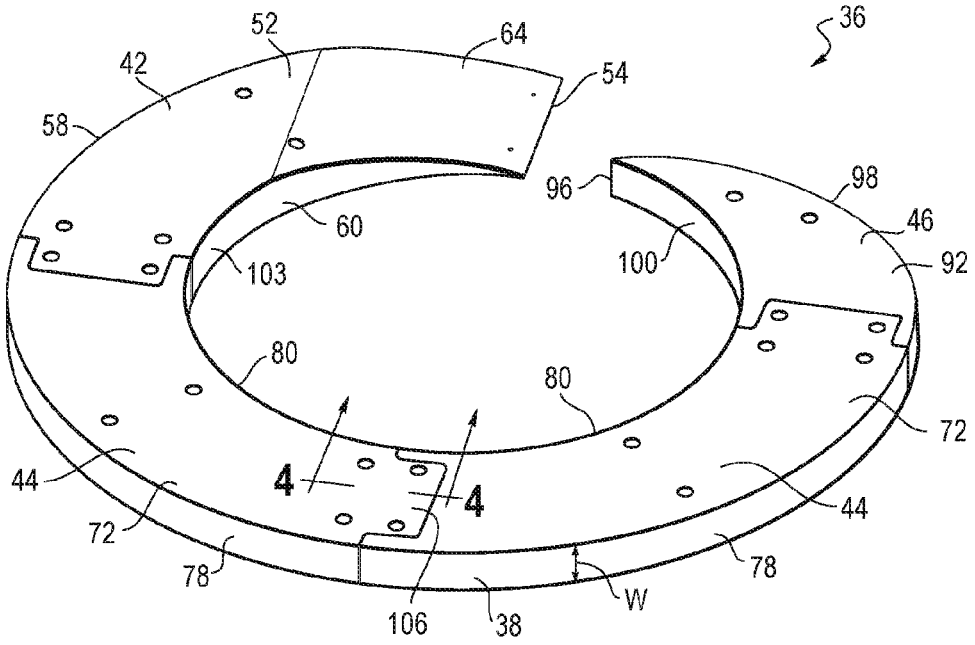
FIG. 3 is a perspective view of a ramp according to the disclosure.

FIG. 3 is a perspective view of a ramp 36 according to the disclosure. The ramp 36 and has a width (W) and a radial height (H) and a smooth continuous cable supporting surface 38. Preferably the width (W) of the cable supporting surface 38 is at least as great as the width of the cable 40.

The ramp surface 38 may be thought of as forming a two-dimensional spiral, beginning an radial distance (D) from the drum surface 23 at the first end of the first ramp section 42, where the ramp 36 is highest, and gradually approaching the drum surface 23 until it meets the drum surface 23 at the second end 96 of the final ramp section 46, where the ramp height is about zero. Viewed another way, the cable supporting surface 38 forms a two-dimensional spiral that extends radially outward from the drum surface 23 and terminates below the radially outer edge 28 of the first flange 24.

The ramp 36 has a cylindrical drum facing surface 103 which mates with the cylindrical surface 23 of the drum 22. The drum facing surface 103 may describe a 360 degree arc or, more preferably, an arc of less than 360 degrees, leaving a gap 104 between the first end 54 of the first ramp section 42 and the second end 96 of the final ramp section 46.

The ramp 36 may comprise two or more sections joined together. For example, the ramp 36 in FIG. 3 comprises four interlocking sections, a first ramp section 42, two intermediate ramp sections 44 and a final ramp section 46. The names of the ramp section is somewhat arbitrary. The first ramp section 42 is so named because it may be the first ramp section that the cable 40 encounters upon being wound onto the reel 20 (see FIG. 13).

Figure 7:
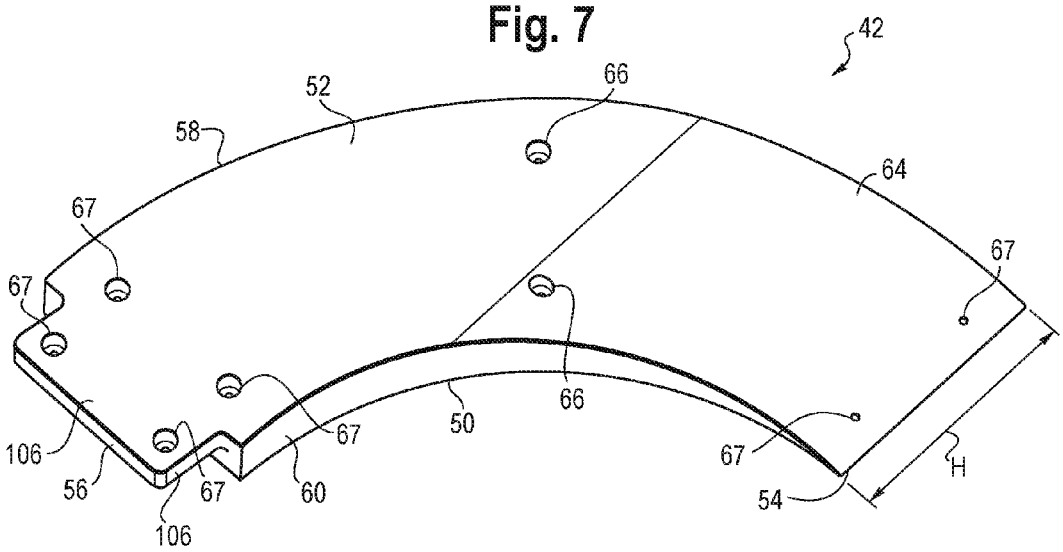
FIG. 7 is a perspective view of a first ramp section.

FIG. 7 is a close up perspective view of the first ramp section 42. The first ramp section 42 comprises a flange facing surface 50, an axially inner facing surface 52, a first end 54, a second end 56, an arcuate radially outer edge 58 and a radially inner circumferential edge 60. The flange facing surface 50 may be planar and mates with the inner side 32 of the first flange 24. The axially inner facing surface 52 may comprise a first surface 62 defining a plane substantially parallel to the flange facing surface 50. The first surface 62 may extend from the second end 56 to a beveled surface 64. The beveled surface 64 may extend from the first surface 62 to the first end 54. The radially outer edge 58 may be curved in the circumferential direction and is configured to carry the cable 40. The inner circumferential edge 60 is also curved and is configured to mate with the drum outer surface 23.

The first ramp section 42 may comprise means for attaching the first ramp section 42 to the reel 20. For example, the first ramp section 42 may comprise flange mounting holes 66 configured to receive bolts 68 or other attachment means. The first ramp section 42 also may comprise means for attaching the first ramp section 42 to another ramp section such as an intermediate ramp section 44. For example, the first ramp section 42 may comprise holes 67 configured to receive bolts 68 or other attachment means. The radial height (H) is the distance from the inner circumferential edge 60 to the radially outer edge 58. The maximum radial ramp height is represented by the letter (D) in the figures.

The first ramp section 42 may be attached to another ramp section such as an intermediate ramp section 44 in any suitable fashion. For example, the first ramp section 42 may comprise a tongue 106 located at the second end 56 to facilitate attachment to another ramp section such as an intermediate ramp section 44. Alternatively, the first ramp section 42 may comprise a slot located at the second end 56 to facilitate attachment to another ramp section.

Figure 8:
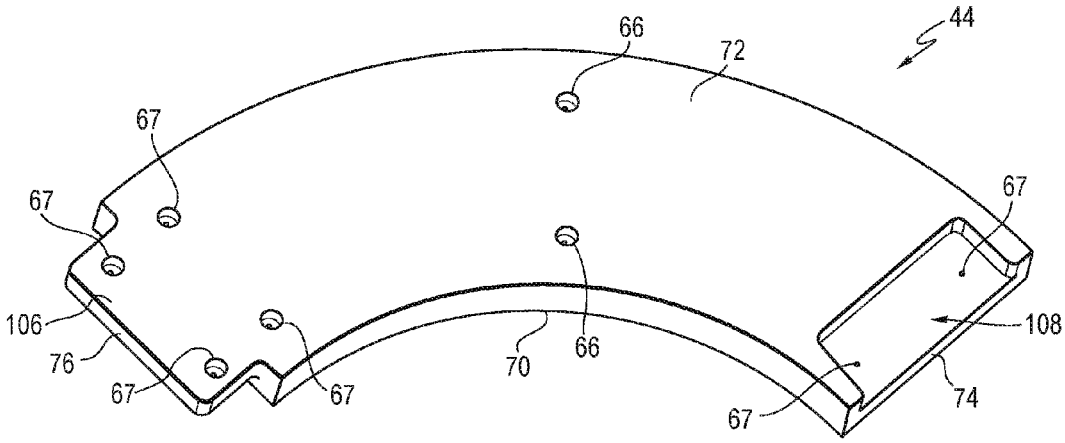
FIG. 8 is a perspective view of an intermediate ramp section.
Figure 9:
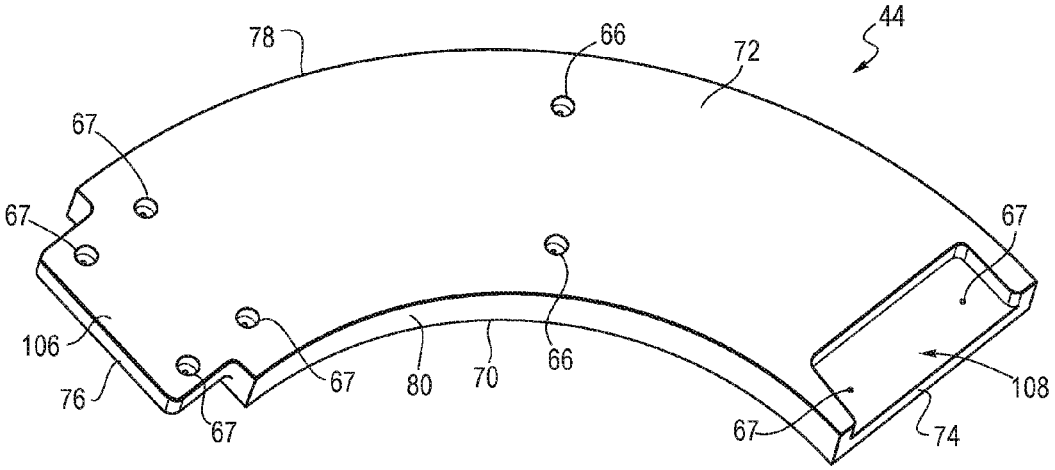
FIG. 9 is a perspective view of a second intermediate ramp section.

FIG. 8 is a perspective view of a first intermediate ramp section 44 shown in FIG. 3, and FIG. 9 is a perspective view of a second intermediate ramp section 44 shown in FIG. 3. Each intermediate ramp section 44 may describe an arc, such as the ninety degree arc shown in the figures. The intermediate ramp sections 44 may be identical as shown here or they may be different. Two intermediate ramp sections 44 are shown in FIG. 3, although there may be any suitable number of intermediate ramp sections 44.

Each intermediate ramp section 44 is interposed between adjacent ramp sections and comprises a flat outer (flange) facing surface 70, an axially inner facing surface 72, a first end 74, a second end 76, a curved radially outer edge 78 and an inner circumferential edge 80. The outer facing surface 70 may be substantially planar and mates with the inner side 32 of the first flange 24. The axially inner facing surface 72 may also be planar. The radially outer edge 78 is configured to carry the cable 40. The inner circumferential edge 80 is configured to mate with the drum outer surface 23. Each intermediate ramp section 44 may comprise means for attaching the intermediate ramp section 44 to the reel 20. For example, the second ramp section 44 may comprise flange mounting holes 66 configured to receive bolts 68 or other attachment means.

Each intermediate ramp section 44 also may comprise at both ends means for attaching the intermediate ramp section 44 to adjacent ramp sections. For example, each intermediate ramp section 44 may comprise at either end holes 67 configured to receive bolts 68 or other attachment means. Each intermediate ramp section 44 may also comprise a tongue 106 located at one or both ends to facilitate attachment to another ramp section. Alternatively, each intermediate ramp section 44 may comprise a slot 108 located at one or both ends to facilitate attachment to another ramp section.

Figure 10:
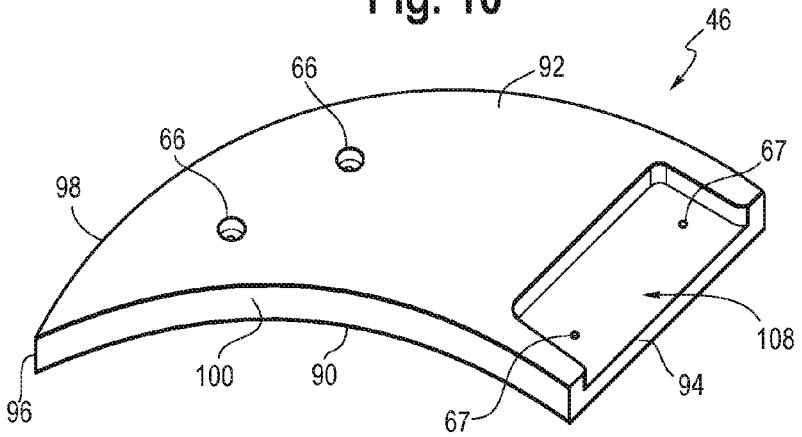
FIG. 10 is a perspective view of a final ramp section.

FIG. 10 is a perspective view of the final ramp section 46. The final ramp section 46 may comprise a flat outer (flange) facing surface 90, an axially inner facing surface 92, a first end 94, a second end 96, a curved radially outer edge 98 and an inner circumferential edge 100. The outer facing surface 90 may be planar and mates with the inner side 32 of the first flange 24. The axially inner facing surface 92 may also be planar. The radially outer edge 98 is configured to carry the cable 40. The inner circumferential edge 100 is configured to mate with the drum outer surface 23.

Like the first ramp section 42 and the intermediate ramp sections 44, the final ramp section 46 may comprise means for attaching the final ramp section 46 to the reel 20. For example, the final ramp section 46 may comprise flange mounting holes 66 configured to receive bolts 68 or other attachment means. The final ramp section 46 also may comprise means for attaching the final ramp section 46 to an adjacent ramp section such as an intermediate ramp section 44. For example, the final ramp section 46 may comprise holes 67 configured to receive bolts 68 or other attachment means.

Figure 4:
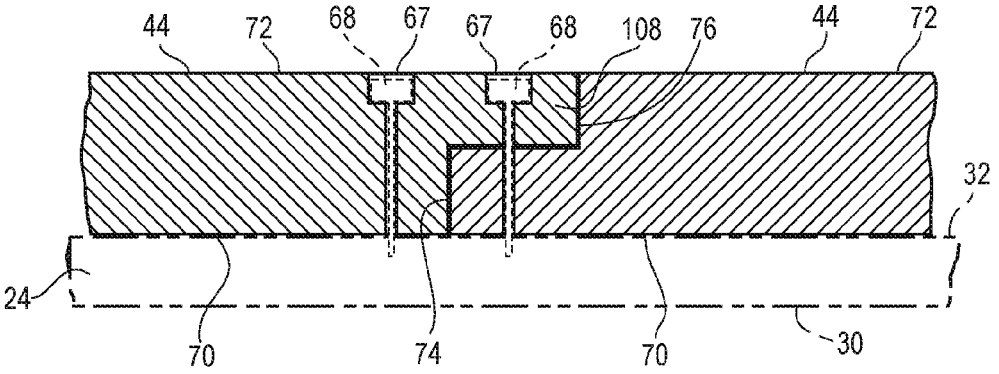
FIG. 4 is a cross-sectional view of the ramp of FIG. 3 taken along line 4-4.

FIG. 4 is a cross-sectional view of the ramp of FIG. 3 taken along line 4-4 and showing two intermediate ramp sections 44 connected together by bolts 68. The bolts 68 extend through the holes 67 and may also extend into the flange 24 to help secure the intermediate ramp sections 44 to the flange 24.

Figure 5:
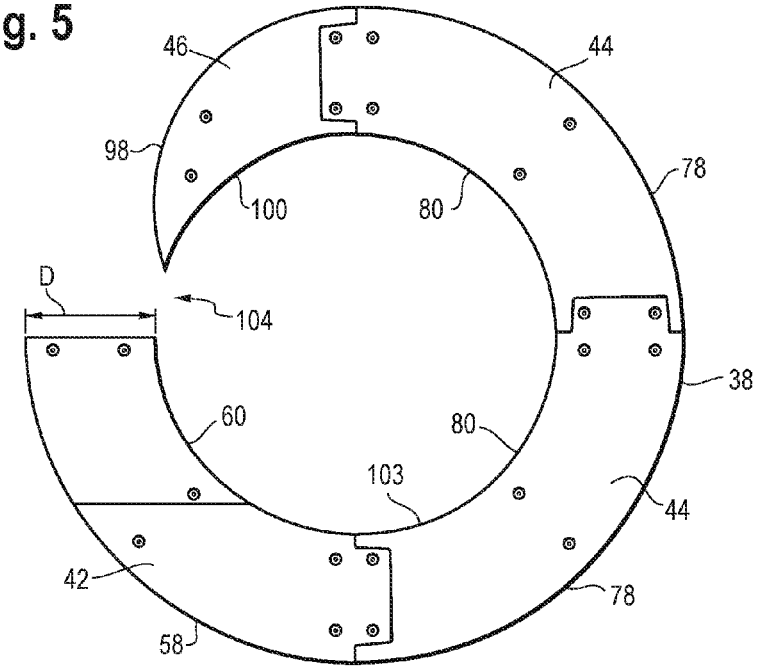
FIG. 5 is an outer (flange) side view of the ramp of FIG. 3.

FIG. 5 is an axially outer (flange side) view of the assembled ramp 36 of FIG. 3. The radially outer facing edges 58, 78, 98 form the cable supporting surface 38 which carries the cable 40. The inner circumferential edges 60, 80, 100 describe a cylindrical drum facing surface 103 which mates with the cylindrical surface 23 of the drum 22 (not shown). The drum facing surface 103 may describe a 360 degree arc or, more preferably, an arc of less than 360 degrees, leaving a gap 104 between the first end 54 of the first ramp section 42 and the second end 96 of the final ramp section 46.

Figure 6:
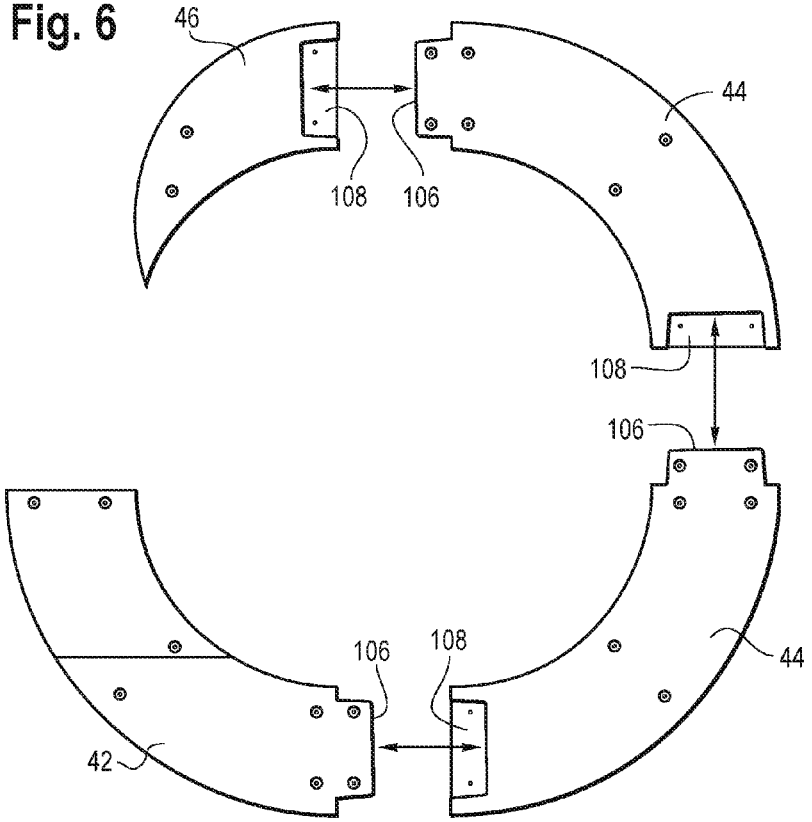
FIG. 6 is an exploded view of the ramp of FIG. 5.

FIG. 6 is an exploded view of the ramp of FIG. 5. In addition to the bolts 68, the ramp sections may fit together in tongue and slot fashion. Thus, each ramp section may comprise a tongue 106 that fits into a slot 108 defined by an adjacent ramp section.

Ramp Assembly

The ramp 36 may be assembled in the following manner.

Figure 11:
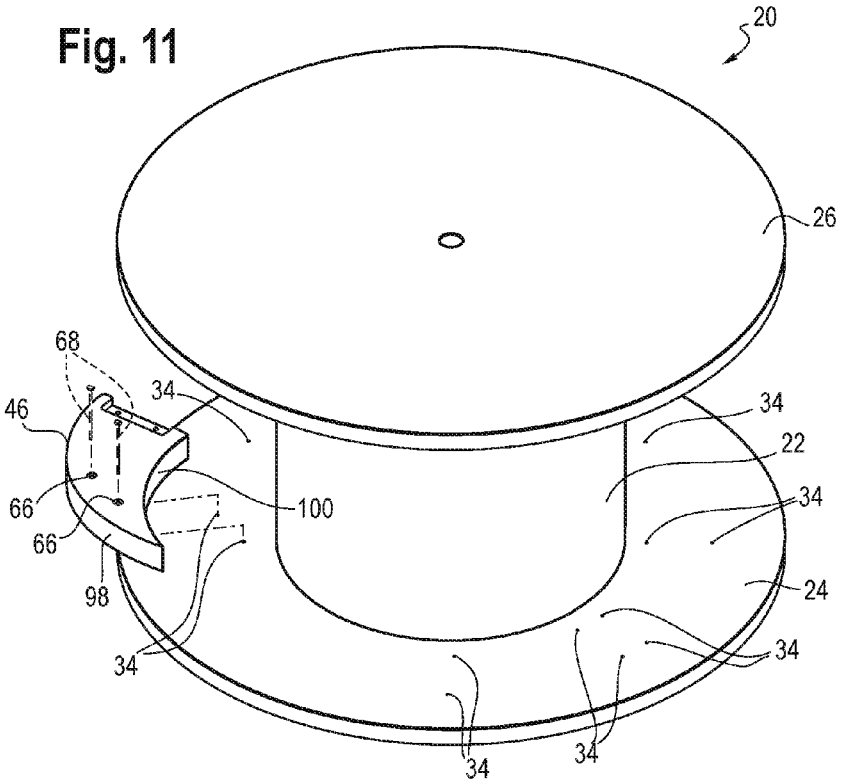
FIG. 11 is a perspective view the final ramp section of FIG. 10 being installed onto a reel.

FIG. 11 is a perspective view the final ramp section 46 of FIG. 10 being installed onto a reel 20. The final ramp section 46 is positioned onto the first flange 24 so that the inner circumferential edge 100 mates with the drum surface 23 and the flange mounting holes 66 align with the receiving holes 34 in the first flange 24. Then bolts 68 or other attachment means are inserted through the mounting holes 66 and receiving holes 34 to secure the final ramp section 46 to the first flange 24.

Next, if applicable, one or more intermediate ramp sections 44 are secured to the first flange 24 in a similar manner. For example, an intermediate ramp section 44 may be positioned onto the first flange 24 so that its inner circumferential edge 80 mates with the drum surface 23 and the flange mounting holes 66 align with the receiving holes 34 in the first flange 24. In addition, the tongue 106 of the intermediate ramp section 44 may be positioned to mate with the slot 108 of an adjacent ramp section such as the final ramp section 46. Each additional intermediate ramp section 44 may be positioned and secured to the first flange 24 in a similar manner.

Figure 12:
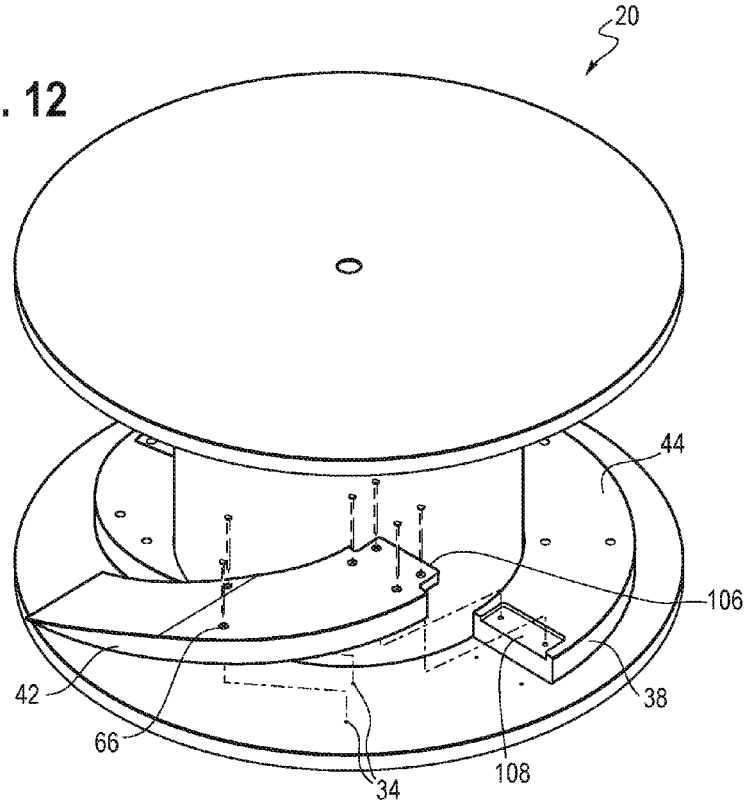
FIG. 12 is a perspective view the first ramp section of FIG. 7 being installed onto a reel.

FIG. 12 is a perspective view the first ramp section of FIG. 7 being installed onto a reel 20. As with the previous ramp sections, the first ramp section 42 is positioned onto the first flange 24 so that the inner circumferential edge 60 (obscured in FIG. 12) mates with the drum surface 23 and the flange mounting holes 66 align with the receiving holes 34 in the first flange 24. Then bolts 68 or other attachment means are inserted through the mounting holes 66 and receiving holes 34 to secure the final ramp section 46 to the first flange 24. In addition, the tongue 106 of the first ramp section 42 may be positioned to mate with the slot 108 of an adjacent ramp section such as the intermediate ramp section 44 shown in the figure. Bolts 68 or other attachment means also are inserted through the mounting holes 66 near the tongue 106 and through receiving holes 34 in the flange to secure the first ramp section 42 to the adjacent ramp section and to the first flange 24.

Cable Winding

A cable 40 or other strand or strand-like material may be wound onto the reel 20 in the following manner. A length of the cable 40 is positioned onto the ramp 36 such that a first cable end 39 is left free and accessible to a testing instrument 110. Then the cable 40 is wound onto the reel drum 22.

Figure 13:
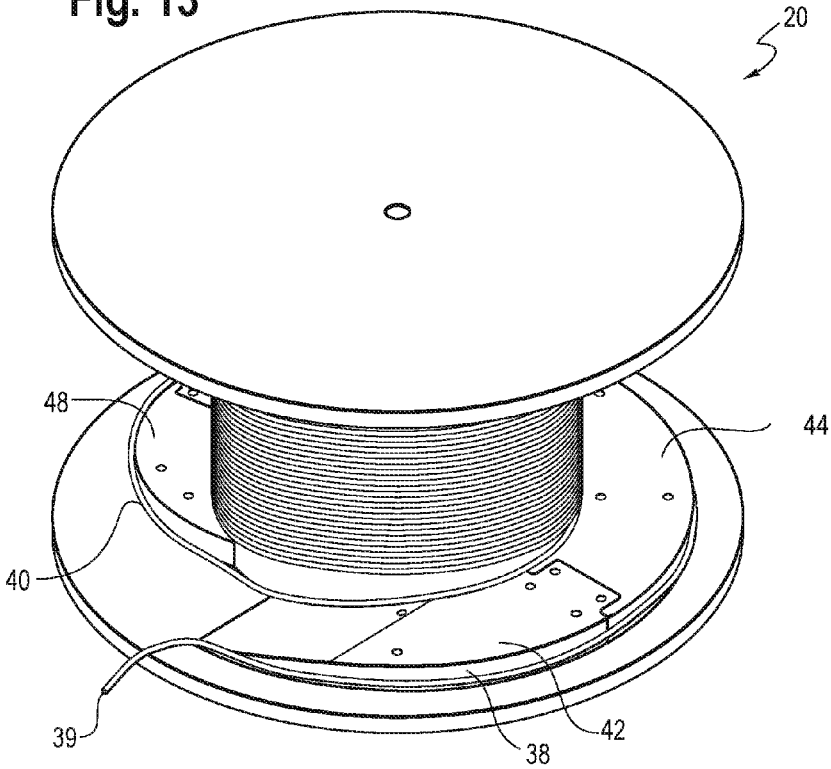
FIG. 13 is a perspective view of a reel according to the disclosure with a partially wound cable.

FIG. 13 is a perspective view of a reel 20 according to the disclosure with a partially wound cable. The first cable end 39 is free and accessible to a testing instrument 110 and some of the cable 40 is wound onto the reel drum 22.

Figure 14:
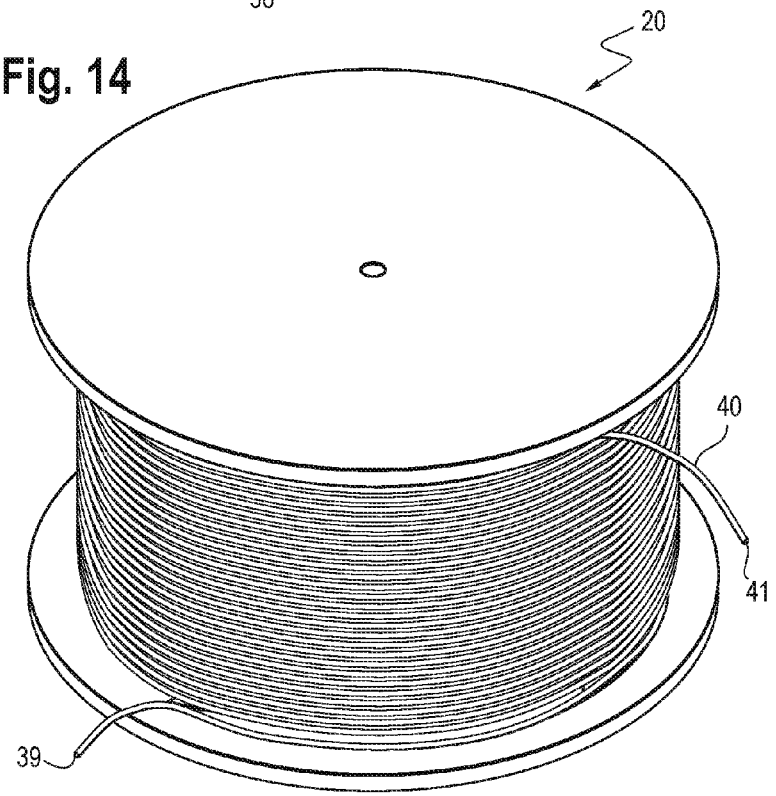
FIG. 14 is a perspective view of a reel according to the disclosure with a fully wound cable.

FIG. 14 is a perspective view of a reel 20 according to the disclosure with a fully wound cable 40. The first cable end 39 remains free and accessible to a testing instrument 110 even after all of the cable 40 is wound onto the reel drum 22. The cable second end 41 is also free and accessible to a testing instrument 110.

Cable Testing

Figure 15:
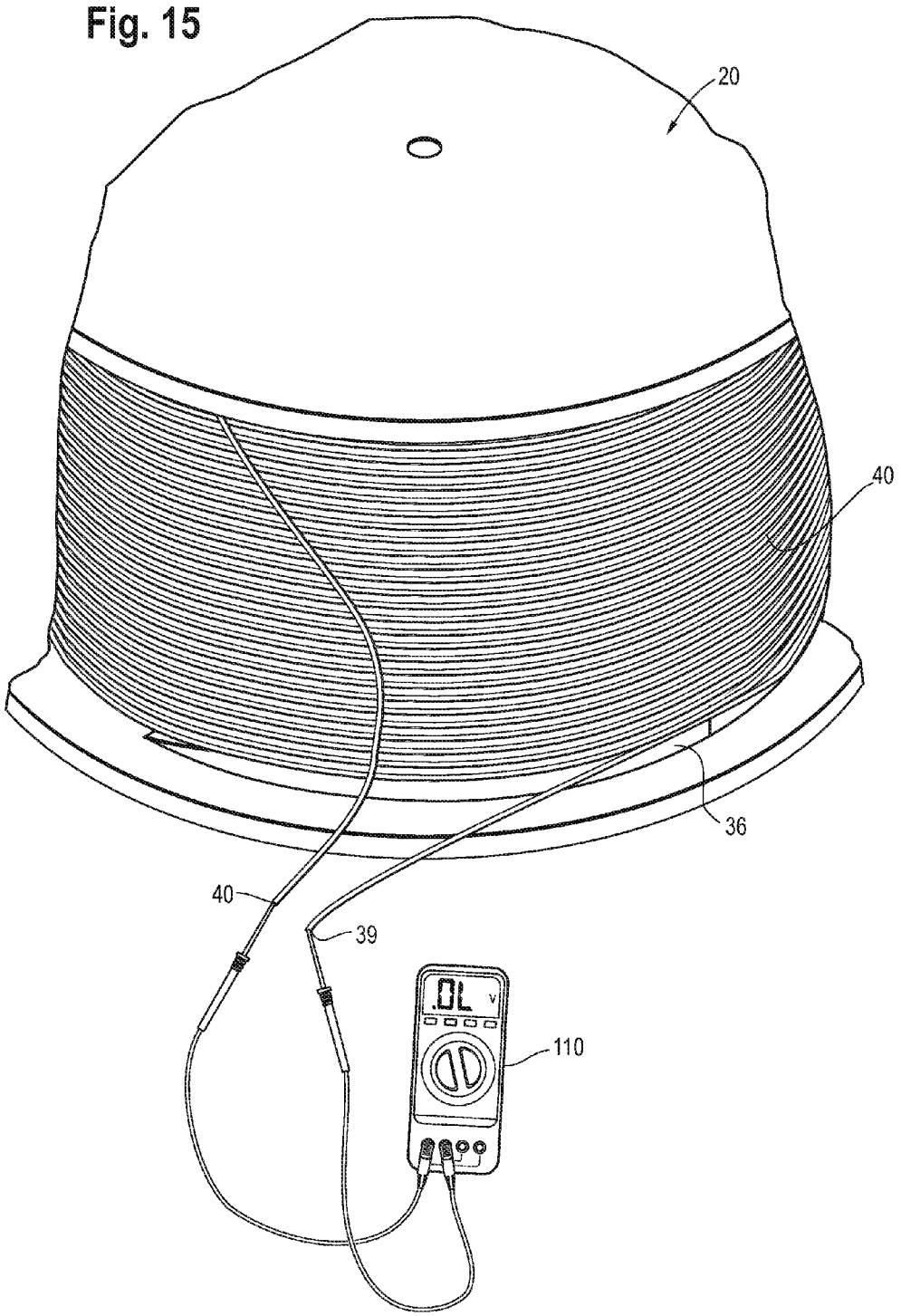
FIG. 15 is a perspective view of a wound cable during testing.

FIG. 15 is a perspective view of a wound cable 40 during testing. A testing instrument 110, such as a continuity tester, is connected to both the first and second ends 39, 41 of the cable 40. A continuity test can determine whether the cable 40 has been compromised.

The ramp 36 may be made in two or more sections and may be made to match the circumference of any drum surface. The ramp 36 is removably mounted to a flange and so can be switched out for a different ramp such as one having a different width or material of construction.

Alternative Ramp

Figure 16:
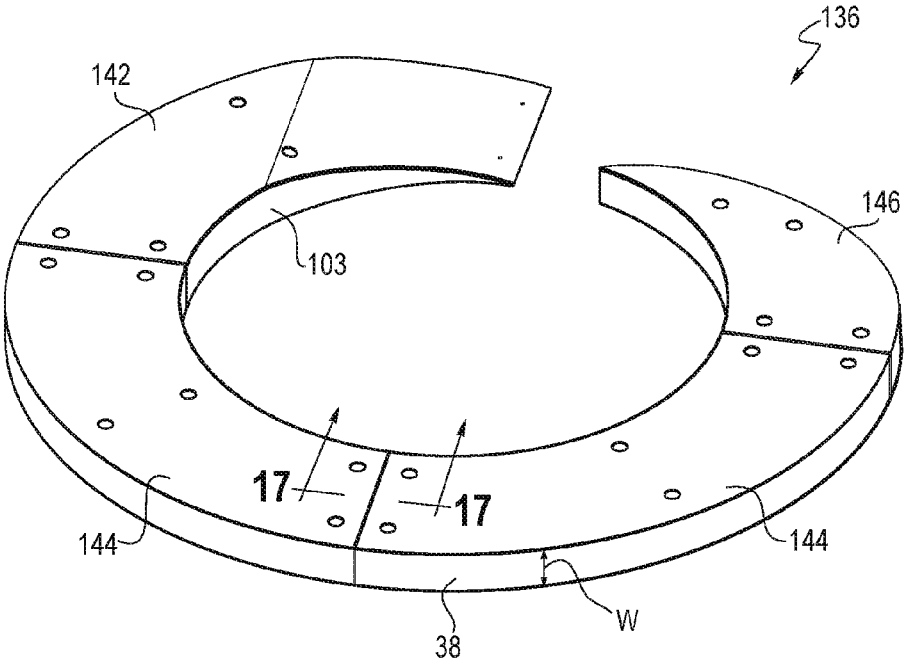
FIG. 16 is a perspective view of an alternative ramp according to the disclosure.

FIG. 16 is a perspective view of an alternative ramp 136 according to the disclosure. The ramp 136 is similar to the previous ramp 36 but lacks the tongue and slot structure of the previous ramp 36. Thus, like the previous ramp 36, the ramp 136 comprises four interlocking sections, a first ramp section 142, two intermediate ramp sections 144 and a final ramp section 146.

Figure 17:
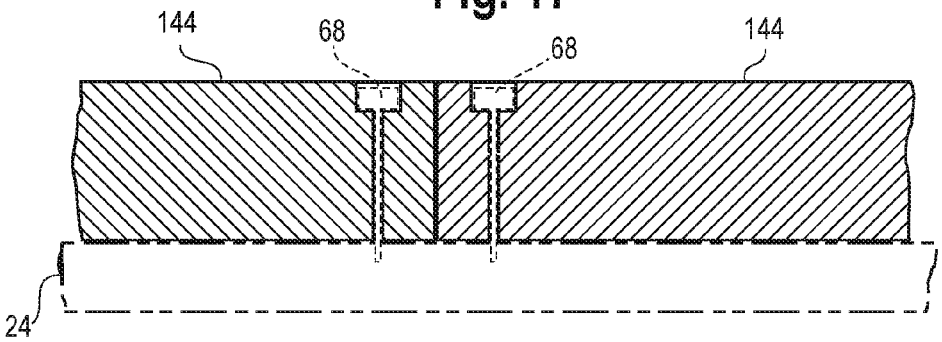
FIG. 17 is a cross-sectional view of the ramp of FIG. 16 taken along line 17-17.

FIG. 17 is a cross-sectional view of the ramp of FIG. 16 taken along line 17-17 and showing two intermediate ramp sections 144 connected together by bolts 68 and attached to the first flange 24 by the same bolts 68.

Figure 18:
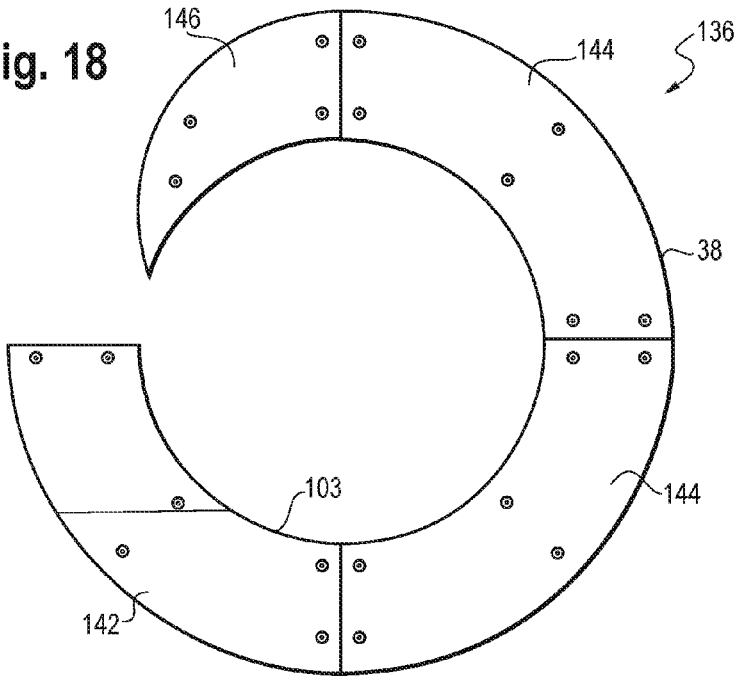
FIG. 18 is an outer (flange) side view of the ramp of FIG. 16.

FIG. 18 is an axially outer (flange side) view of the assembled ramp 136 of FIG. 16. The inner circumferential edges describe a cylindrical drum facing surface 103 which mates with the cylindrical surface 23 of the drum 22 (not shown). The radially outer facing edges form a ramp surface or cable supporting surface 38 which carries a cable 40, wire or other strand or strand-like material.

Figure 19:
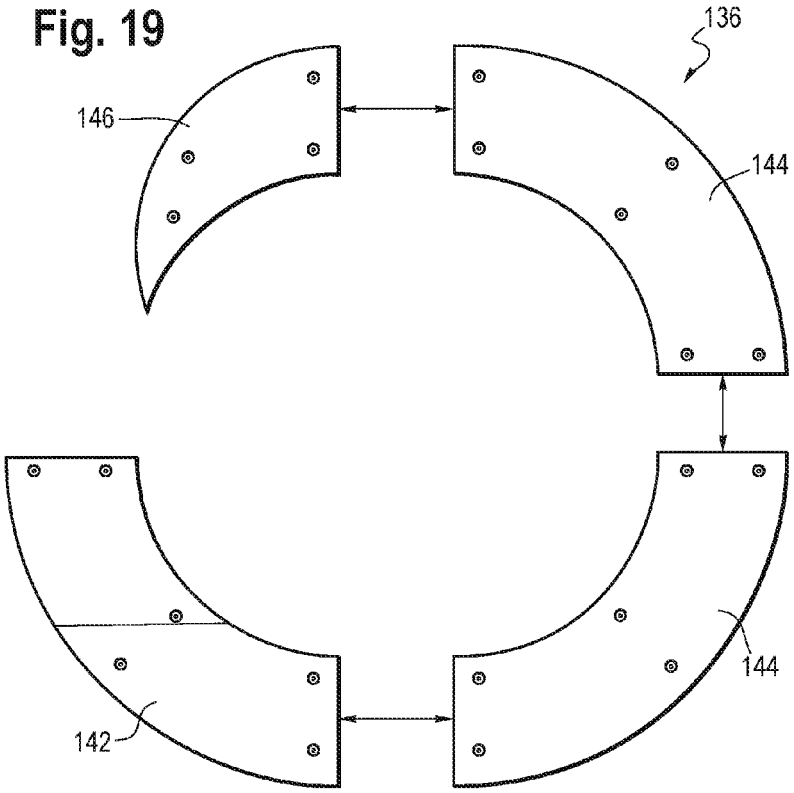
FIG. 19 is an exploded view of the ramp of FIG. 18.

FIG. 19 is an exploded view of the ramp of FIG. 18. The ramp sections lack the tongue and slot structure of the previous ramp 36. Instead, the ramp ends are flat or of a configuration that allows them to simply abut each other.

Reel System

A reel system may be provided for winding cables of varying diameters. The reel system may comprise:

a reel 20 comprising a drum 22 configured to receive wound cable 40, the drum 22 having an axis and a circumference, the drum 22 having a substantially cylindrical drum surface 23 and opposing axial ends; first and second disc-shaped flanges 24, 26 affixed to the drum ends, each flange having an inner side, an outer side and a cylindrical radially outer edge; and a plurality of substantially arcuate ramps 36 of different widths, each ramp 36 having a smooth continuous cable supporting surface 38 and configured to extend circumferentially around all or part of the drum surface 23 adjacent the inner side of one of the flanges. Each ramp 36 may comprise at least two sections joined together and configured to be removably affixed to the reel.

INDUSTRIAL APPLICABILITY

This there has been described one or more embodiments of a removable ramp for a reel. The ramp may be metal or made of a non-metal material such as foam or plastic. The ramp can be bolted onto the reel in sections. The ramp enables both cable ends to remain exposed and free after winding for easier access during testing.

The ramp speeds up manufacturing time of the reels and lowers costs. The ramp also provides customers the option to remove the ramp when not needed or to replace it with a different size (width) ramp when changing cable sizes, instead of purchasing a complete new reel.

The ramp can save weight. Trucks carrying wound cable reels often have a weight limit that is reached before they reach the load capacity of the reels. Using lower weight ramps (made of materials lighter then metal) allows shippers to load more cable onto the reels.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A reel for winding cable, the reel comprising:

a drum defining a longitudinal axis, the drum comprising opposing axial ends and a cylindrical drum surface;

a first flange affixed to one drum end and a second flange affixed to the other drum end, the first flange having a radially outer edge, an inner side facing the drum and an outer side; and a ramp extending around part of the drum adjacent the inner side of the first flange, the ramp having a cylindrical drum facing surface which mates with the cylindrical surface of the drum, the ramp having a width (W) and a smooth continuous cable supporting surface; wherein the ramp is removably affixed to the first flange.

2. The reel of claim 1 wherein:

the ramp comprises at least two sections joined together.

3. The reel of claim 2 wherein:

the drum facing surface describes an arc of less than 360 degrees.

4. The reel of claim 3 wherein:

each section is removably affixed to the first flange.

5. The reel of claim 1 wherein:

the cable supporting surface forms a two-dimensional spiral that extends radially outward from the drum surface and terminates below the radially outer edge of the first flange.

6. The reel of claim 2 wherein the ramp comprises:

a first ramp section attached to the first flange; and a final ramp section attached to the first flange.

7. The reel of claim 6 wherein:

the first ramp section comprises a flange facing surface, an axially inner facing surface, a first end, a second end, an arcuate radially outer edge and a radially inner circumferential edge, the flange facing surface configured to mate with the inner side of the first flange, the axially inner facing surface comprising a beveled surface extending from the first end, the radially outer edge configured to carry the cable and the inner circumferential edge configured to mate with the drum outer surface; and the final ramp section comprises a flange facing surface, an axially inner facing surface, a first end, a second end, a curved radially outer edge and an inner circumferential edge, the flange facing surface configured to mate with the inner side of the first flange, the axially inner facing surface configured to carry the cable and the inner circumferential edge configured to mate with the drum outer surface.

8. The reel of claim 6 further comprising:

one or more intermediate ramp sections interposed between the first ramp section and the final ramp section, each intermediate ramp section being attached to the first flange.

9. The reel of claim 8 wherein:

each ramp section comprises a tongue that fits into a slot defined by an adjacent ramp section.

10. The reel of claim 1 wherein:

the ramp is made of a non-metallic material.

11. A ramp for use with a reel for winding a strand-like material, the reel comprising a drum and opposing first and second flanges, the drum having a cylindrical drum surface, the ramp having a cylindrical inner surface configured to mate with a cylindrical surface of the drum and a smooth continuous strand supporting surface, the strand supporting surface having a two-dimensional spiral configuration extending radially outward from the drum surface, the ramp characterized in that:

the ramp comprises a plurality of sections, each section configured to be removably affixed to a flange.

12. The ramp of claim 11 wherein:

the drum facing surface describes an arc of less than 360 degrees.

13. The ramp of claim 11, the ramp comprising:

a first ramp section attached to the first flange; and a final ramp section attached to the first flange.

14. The ramp of claim 13 wherein:

the first ramp section comprises a flange facing surface, an axially inner facing surface, a first end, a second end, an arcuate radially outer edge and a radially inner circumferential edge, the flange facing surface configured to mate with an inner side of the first flange, the axially inner facing surface comprising a beveled surface extending from the first end, the radially outer edge configured to carry the cable and the inner circumferential edge configured to mate with the drum outer surface; and the final ramp section comprises a flange facing surface, an axially inner facing surface, a first end, a second end, a curved radially outer edge and an inner circumferential edge, the flange facing surface configured to mate with the inner side of the first flange, the axially inner facing surface configured to carry the cable and the inner circumferential edge configured to mate with the drum outer surface.

15. The ramp of claim 14 further comprising:

one or more intermediate ramp sections interposed between the first ramp section and the final ramp section, each intermediate ramp section being attached to the first flange.

16. The ramp of claim 11 wherein:

the ramp is made of a non-metallic material.

17. A reel system for winding cables of varying diameters, the reel system comprising:

a reel comprising a pair of flanges affixed to a drum configured to receive wound cable, the drum having an axis and a circumference, the drum having a substantially cylindrical outer surface and opposing axial ends; first and second disc-shaped flanges affixed to the ends, each flange having an inner facing surface, an outer facing surface and a cylindrical outer edge; and a plurality of substantially arcuate ramps of different widths, each ramp having a smooth continuous cable supporting surface and configured to extend circumferentially around part of the drum outer surface adjacent the inner facing surface of one of the flanges, each ramp comprising at least two sections joined together and configured to be removably affixed to the reel.

* * * * *